US007937908B2

(12) United States Patent
Anzini et al.

(10) Patent No.: US 7,937,908 B2
(45) Date of Patent: May 10, 2011

(54) DUAL HOT MELT ADHESIVE SYSTEMS

(75) Inventors: David J. Anzini, Middletown, NY (US); Rusty Koenigkramer, Nanuet, NY (US); Glyn Russell, New City, NY (US); Ernesto L. Pitargue, Carmel, NY (US); Arthur A. Bucci, Yardley, PA (US)

(73) Assignee: Illinois Tool Works Inc., Glenview, IL (US)

( * ) Notice: Subject to any disclaimer, the term of this patent is extended or adjusted under 35 U.S.C. 154(b) by 80 days.

(21) Appl. No.: 12/228,804

(22) Filed: Aug. 15, 2008

(65) Prior Publication Data

US 2009/0056278 A1 Mar. 5, 2009

Related U.S. Application Data

(60) Provisional application No. 60/965,097, filed on Aug. 17, 2007.

(51) Int. Cl.
*B65B 61/18* (2006.01)

(52) U.S. Cl. ..... 53/412; 53/133.4; 53/139.2; 383/61.3; 383/203; 493/213; 493/214; 493/927; 156/66

(58) Field of Classification Search ..... 53/412, 53/133.4, 139.2; 493/212–214, 927; 383/5, 383/63, 61.3, 203, 204, 207; 156/66; 24/64
See application file for complete search history.

(56) References Cited

U.S. PATENT DOCUMENTS

| | | | | |
|---|---|---|---|---|
| 4,855,382 | A | 8/1989 | Vanhaeren | |
| 5,462,360 | A | 10/1995 | Tilman et al. | |
| 5,749,658 | A | 5/1998 | Kettner | |
| 6,317,939 | B1 | 11/2001 | Malin | 24/304 |
| 6,354,738 | B1 | 3/2002 | Buckman et al. | |
| 6,505,383 | B2 | 1/2003 | Machacek et al. | 24/30.5 R |
| 6,601,370 | B2 | 8/2003 | Colombo et al. | 53/473 |
| 6,830,377 | B2 | 12/2004 | Schneider | 383/5 |
| 6,910,805 | B2 | 6/2005 | Johnson | |
| 7,249,887 | B2 | 7/2007 | Kinigakis et al. | 383/61.2 |
| 2005/0031233 | A1 | 2/2005 | Varanese et al. | 383/211 |
| 2006/0285778 | A1 | 12/2006 | May et al. | 383/63 |
| 2008/0047228 | A1 | 2/2008 | Anzini et al. | |
| 2008/0050052 | A1 | 2/2008 | Anzini et al. | |
| 2008/0050056 | A1 | 2/2008 | Anzini et al. | |
| 2008/2202212 | | 9/2008 | Lin et al. | 428/138 |
| 2009/0042706 | A1 | 2/2009 | Howell et al. | 493/213 |

OTHER PUBLICATIONS

U.S. Appl. No. 11/728,477.
U.S. Appl. No. 11,728,405.
U.S. Appl. No. 11/728,413.

*Primary Examiner* — Thanh K Truong
(74) *Attorney, Agent, or Firm* — Day Pitney LLP

(57) ABSTRACT

The present disclosure relates to the use of first and second adhesives for the attachment of zipper flanges to reclosable packages. A first adhesive is typically a reactive, cross-linkable hot melt adhesive while the second adhesive is typically non-cross-linkable hot melt adhesive, typically, but not limited to, either EVA-based or polyamide-based. Alternatively, the second adhesive can be a coextrusion layer including a resin that is typically used as a sealant layer in zipper extrusion, such as metallocene type linear low density polyethylene.

16 Claims, 2 Drawing Sheets

DUAL HOT MELT ADHESIVE SYSTEMS

This application claims priority under 35 U.S.C. §119(e) of provisional application Ser. No. 60/965,097 filed on Aug. 17, 2007, the contents of which is hereby incorporated by reference.

BACKGROUND OF THE INVENTION

1. Field of the Invention

The present invention relates to the use of hot melt adhesive in the construction of reclosable packages having a high burst zipper.

2. Description of the Prior Art

Hot melt adhesives have a long history of use in the packaging industry, as well as many other industries. In particular, these adhesives are particularly adaptable to use in large bag applications, such as those used for pet food, charcoal, kitty litter, rice, etc. Typical construction of these packages or bags includes lap seams, pinch bottom seals, and zipper reclosures that are all sealed by hot melt adhesives.

EVA-based non-cross-linkable hot melt adhesives have been used for years, because they are easy to apply, and they set up quickly, allowing for line speed efficiency. While they are an industry standard, they do not have the ability to withstand a hot load test, where the glue seam is subject to a load under high heat environments, such as described previously in application Ser. No. 11/728,477 entitled "High Burst Zipper Assembly for Reclosable Packages"; application Ser. No. 11/728,405 entitled "Method of Producing High Burst Zipper Assemblies for Large Reclosable Packages"; and application Ser. No. 11/728,413 entitled "Hot Melt Adhesive Systems for Zipper Assemblies on Large Bag Constructions of Various Substrates", all filed on Mar. 26, 2007, and all hereby incorporated by reference. The reactive, cross-linkable hot melts described therein can withstand the rigors of the hot load test, but they do not have the initial strength or hot tack of the EVA based hot melts. In this case, hot tack refers to the ability of the glue seam to immediately be able to withstand a shearing force on the seam without the substrates creeping under the shear load. The high initial strength or hot tack is particularly important for preventing the thickness of the bag from prying the glue joint open at the flanges and for maintaining high production rates and speeds during manufacture. A similar reclosable package is disclosed in U.S. Pat. No. 6,354,738 entitled "Tamper Evident Reclosable Plastic Bag" issued to Buckman on Mar. 12, 2002.

In short, EVA-based and polyamide-based non-cross-linkable adhesives have generally had good hot tack performance but poor hot load performance, while reactive, cross-linkable adhesives have had fair hot tack performance but excellent hot load performance.

OBJECTS AND SUMMARY OF THE INVENTION

It is therefore an object of the present invention to provide an adhesive, or a combination of adhesives, for the construction of reclosable packages, particularly large reclosable packages, wherein high initial or hot tack strength is achieved, particularly with respect to shearing forces, and, likewise, high strength is maintained during prolonged loads at high temperature.

This and other objects are attained by providing a combination of the reactive-cross-linkable hot melt adhesive with one of the non-cross-linkable adhesives. The combination of adhesives is done by laying separate beads of adhesive on the seam to be glued, the two adhesives do not need to be mixed, and the glue beads are laid side by side on the glue seam. The combination of adhesives will produce a bond that has the initial hot tack to prevent the seam from failing under high tensions or shear loads immediately after the glue application, while the reactive, cross-linkable glue will provide the high strength properties that are necessary to pass severe testing and environmental conditions, such as the hot load test.

A related aspect of the invention combines the reactive, cross-linkable hot melt adhesive with a zipper (typically in a large bag application) that has a heat sealable coextruded resin on the bottom edge of the zipper flange. The extrusion layer includes a resin that is typically used as a sealant layer in zipper extrusion. One example of this type of resin is a metallocene type LLDPE. After the zipper is applied to the package or bag substrate, a hot crush is applied to the bottom of the zipper flange at the part of the zipper that overhangs the package or bag. The hot seal holds the flange together until the glue has time to cure.

DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENTS

Figure 1:
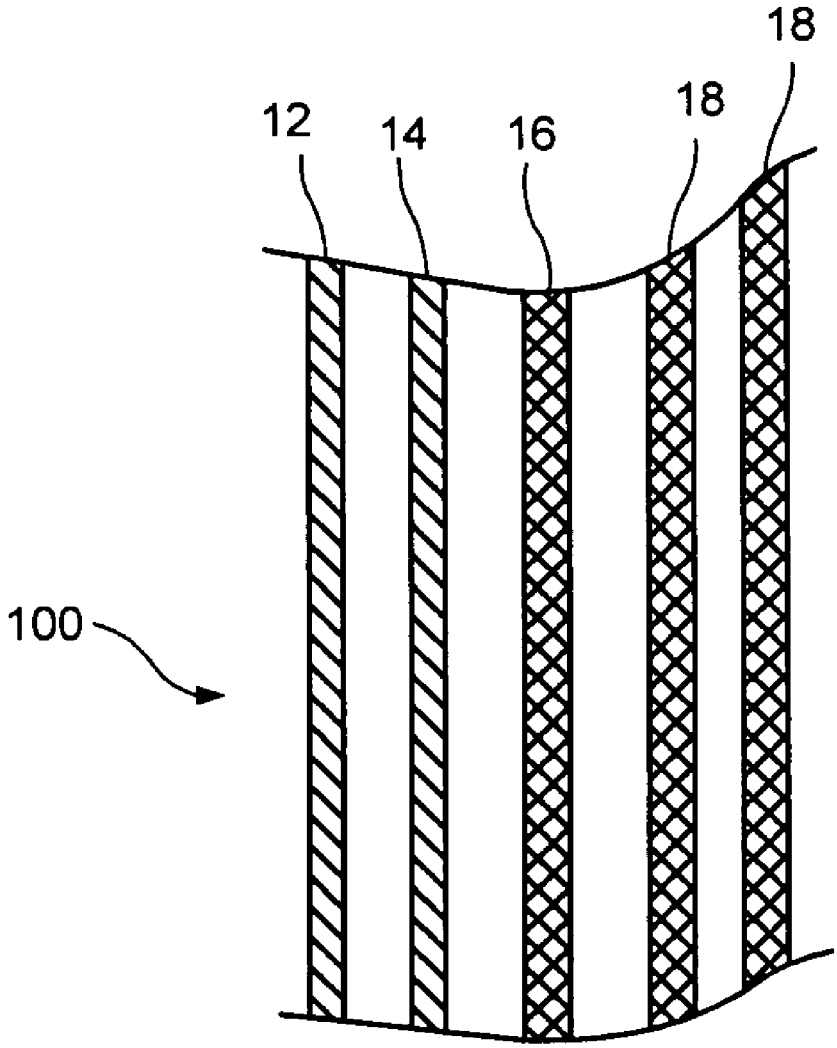
FIG. 1 is a plan schematic of a typical configuration of the two hot melt components in the use of an aspect of the present invention.

Referring now to the drawings in detail wherein like numerals refer to like elements throughout the several views, one sees that FIG. 1 is a plan schematic of a typical configuration of an aspect of the present invention. Two substantially parallel lines 12, 14 of a first adhesive are laid down adjacent to and parallel to three substantially parallel lines 16, 18, 20 of a second adhesive. These substantially parallel lines of adhesive are typically laid down on a substrate 100 of the web used to form the walls of a reclosable package or bag or the flanges of a zipper secured to the package walls (see FIG. 2). The substrate 100 can be any number of materials known to those skilled in the art for the production of reclosable package or bags, particularly large reclosable packages or bags—laminate films, plain poly film, multi-wall paper, woven polypropylene, etc. Different numbers of lines can be used for both the first adhesive and the second adhesive, depending upon the requirements of the specific application. Additionally, in all aspects of the invention, it is envisioned that the various glue or adhesive layers could be applied first to either the zipper or the bag.

The first adhesive is typically a reactive, cross-linkable hot melt adhesives and the second adhesive is typically a non-cross-linkable hot melt adhesive, typically, but not limited to, either EVA-based or polyamide-based. Alternatively, the second adhesive can be a coextrusion layer including a resin that is typically used as a sealant layer in zipper extrusion, such as metallocene type LLDPE (linear low density polyethylene). When this alternative of LLDPE is used, typically after the zipper is applied to the bag substrate, a hot crush is applied to the bottom edge of the zipper flange at the part of the zipper that overhangs the bag.

Figure 2:
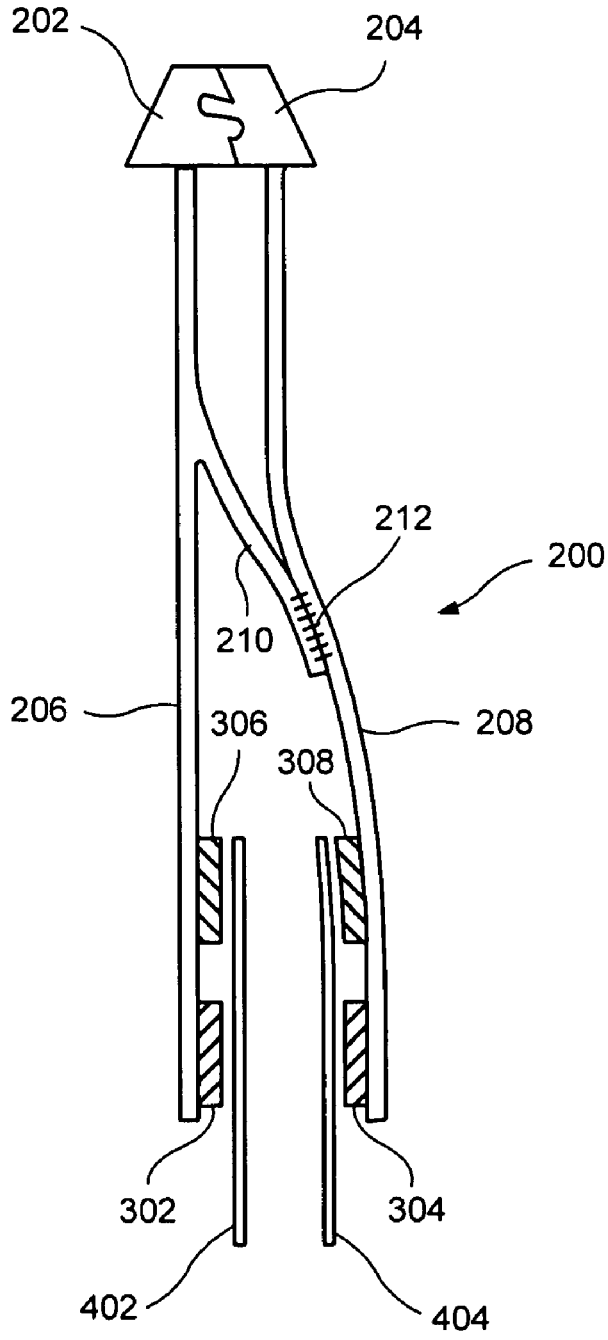
FIG. 2 is a cross-sectional view illustrating an alternative aspect of the present invention, using a coextrusion layer in place of the second adhesive.

The alternative aspect of the present invention is shown in FIG. 2. A zipper 200 with first and second interlocking elements 202, 204 is disclosed. First and second exterior flanges 206, 208 extend from respective first and second interlocking elements 202, 204. Interior flange 210 is formed integrally with first exterior flange 206 and is sealed to second exterior flange 208 at point 212. First and second exterior flanges 206, 208 are sealed, glued or otherwise fastened or attached to respective first and second walls 402, 404 of a reclosable package. In the current configuration, the interior of first and second exterior flanges 206, 208 are affixed (as described above) to the exterior of respective first and second walls 402, 404 of a reclosable package, but it is envisioned that the exterior of first and second exterior flanges 206, 208 could be affixed to the interior of respective first and second walls 402, 404 of a reclosable package. In this alternative aspect of the present invention, coextrusion layers 302, 304 are formed on the distal ends of first and second exterior flanges 206, 208 to provide the capability to seal the first and second exterior flange 206, 208 to the exterior of the respective first and second walls 402, 404 of a reclosable package. First and second reactive cross-linkable hot melt adhesive layers 306, 308 are deposited (possibly as one line or as a plurality of parallel lines) on the first and second exterior flanges 206, 208 inwardly adjacent from first and second coextrusion layers 302, 304. The virtually immediate sealing capability of the first and second coextrusion layers 302, 304 secures the first and second exterior flanges 206, 208 to the respective first and second walls 402, 404 while the first and second reactive cross-linkable hot melt adhesive layers 306, 308 cure.

As described above, the first and second extrusion layers are typically metallocene type LLDPE (linear low density polyethylene) while the first and second reactive cross-linkable hot melt adhesive layers 306, 308 are typically reactive, cross-linkable hot melt adhesive.

As described previously, a hot crush, including heat and pressure, is applied to the bottom edge of the first and second exterior flanges 206, 208 at the part of the zipper that overhangs the reclosable package or bag.

Thus the several aforementioned objects and advantages are most effectively attained. Although preferred embodiments of the invention have been disclosed and described in detail herein, it should be understood that this invention is in no sense limited thereby and its scope is to be determined by that of the appended claims.

What is claimed is:

1. The process of attaching a zipper to a package, comprising the steps of:

providing a zipper;

providing a package;

applying a first adhesive on either the zipper or the package, wherein the first adhesive is a reactive, cross-linkable hot melt adhesive;

applying a second adhesive adjacent to the first adhesive, wherein the second adhesive is a non-cross-linkable hot melt adhesive; and bringing the zipper and package together whereby the zipper is fastened to the package by the first and second adhesives and whereby the second adhesive provides an initial tack immediately after the step of bringing the zipper and package together, thereby allowing the first adhesive to cure whereby the first adhesive provides subsequent increased strength.

2. The process of claim 1 wherein the second adhesive is EVA-based.

3. The process of claim 1 wherein the second adhesive is polyamide-based.

4. The process of claim 1 wherein the first adhesive is applied as at least one line.

5. The process of claim 4 wherein the second adhesive is applied as at least one line.

6. The process of claim 1 wherein the first adhesive is applied as a first plurality of substantially parallel lines.

7. The process of claim 6 wherein the second adhesive is applied as a second plurality of substantially parallel lines.

8. The process of claim 7 wherein the first plurality of substantially parallel lines is substantially parallel to the second plurality of substantially parallel lines.

9. The process of attaching a zipper to a package, comprising the steps of:

providing a zipper with a first flange and a second flange;

providing a package with a first wall and a second wall;

applying an adhesive on either the first and second flange or the first and second wall, wherein the adhesive is a reactive, cross-linkable hot melt adhesive;

applying a coextrusion layer adjacent to the adhesive on either the first and second flange or the first and second wall, wherein the coextrusion layer is metallocene type linear low density polyethylene; and bringing the first flange together with the first package wall and the second flange together with the second package wall whereby the first and second flanges are fastened to the respective first and second package walls by the adhesive and the coextrusion layer, whereby the coextrusion layer provides an initial tack immediately after the step of bringing the first flange and the first package wall together, thereby allowing the adhesive to cure whereby the adhesive provides subsequent increased strength.

10. The process of claim 9 wherein the adhesive is applied as at least one line on the first and second wall or the first and second flange.

11. The process of claim 10 wherein the coextrusion layer is applied as at least one line on the first and second wall or the first and second flange.

12. The process of claim 11 wherein the at least one line of coextrusion layer is substantially parallel to the plurality of substantially parallel lines of adhesive.

13. The process of claim 9 wherein the adhesive is applied as a plurality of substantially parallel lines on the first and second wall or the first and second flange.

14. The process of claim 9 wherein the coextrusion layers are formed on interior distal ends of the first and second flanges and wherein the adhesive is provided on the first and second flanges inwardly adjacent from the coextrusion layers.

15. The process of claim 9 wherein the interior of the first and second zipper flanges are secured to the exterior of the first and second package walls.

16. The process of claim 9 wherein heat and pressure are applied to the coextrusion layer.

* * * * *